United States Patent [19]

Maffei

[11] 4,150,910

[45] Apr. 24, 1979

[54] CONSTRUCTION OF UNDERGROUND GALLERIES

[75] Inventor: Carlos E. M. Maffei, Sao Paulo, Brazil

[73] Assignee: Promon Engenharia SA, Sao Paulo, Brazil

[21] Appl. No.: 836,105

[22] Filed: Sep. 23, 1977

[30] Foreign Application Priority Data

Aug. 19, 1977 [BR] Brazil ..... 770555

[51] Int. Cl.[2] ..... F16L 9/22; E01G 5/06; E21D 9/00

[52] U.S. Cl. ..... 405/149; 405/132

[58] Field of Search ..... 61/42, 41 A, 41 R, 105, 61/106, 43, 84, 36 B, 11

[56] References Cited

U.S. PATENT DOCUMENTS

| | | | |
|---|---|---|---|
| 986,068 | 3/1911 | Knapp | 61/41 R |
| 1,644,476 | 10/1927 | Kennedy | 61/84 X |
| 1,722,038 | 7/1929 | Dougherty | 61/43 X |
| 3,508,406 | 4/1970 | Fisher | 61/16 |
| 3,774,683 | 11/1973 | Smith et al. | 61/36 B X |
| 3,891,186 | 6/1975 | Thorsell | 61/11 X |
| 4,050,255 | 9/1977 | Ahlgren | 61/84 X |
| 4,068,488 | 1/1978 | Ball | 61/105 |

FOREIGN PATENT DOCUMENTS

| | | | |
|---|---|---|---|
| 1143155 | 1/1963 | Fed. Rep. of Germany | 61/105 |
| 1434096 | 4/1976 | United Kingdom | 61/105 |

*Primary Examiner*—Dennis L. Taylor

*Attorney, Agent, or Firm*—Ladas, Parry, Von Gehr, Goldsmith & Deschamps

[57] ABSTRACT

A method of constructing a gallery in which a trench is excavated and the gallery is either constructed in or lowered into the excavation. The gallery is braced internally to withstand external loads applied. Thereafter a controlled backfill is applied around and over the gallery in such manner that with removal of the bracing the backfill acts effectively to form an arch above the gallery which together with the gallery is sufficient to support the overlying covering material up to the ground surface.

24 Claims, 16 Drawing Figures

FIG. 2a
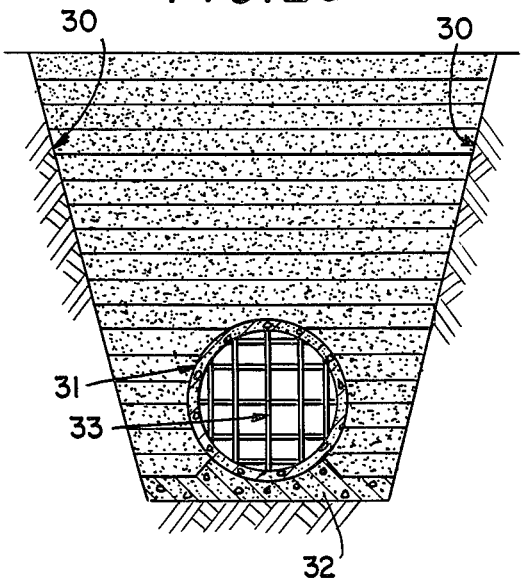
FIG. 2b
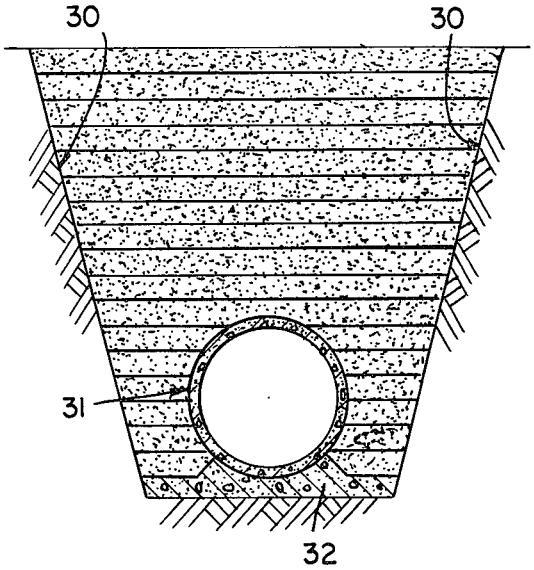
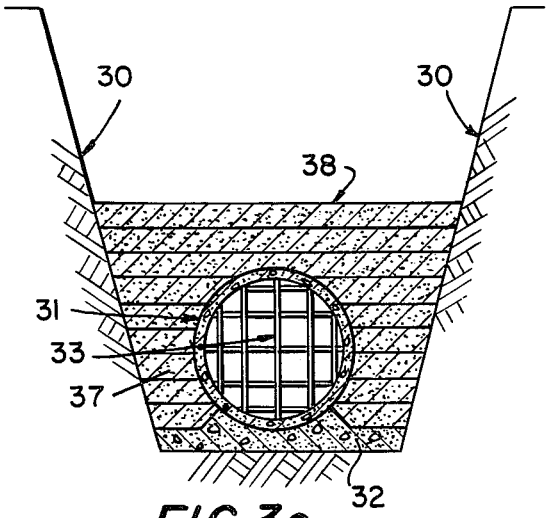
FIG. 3a
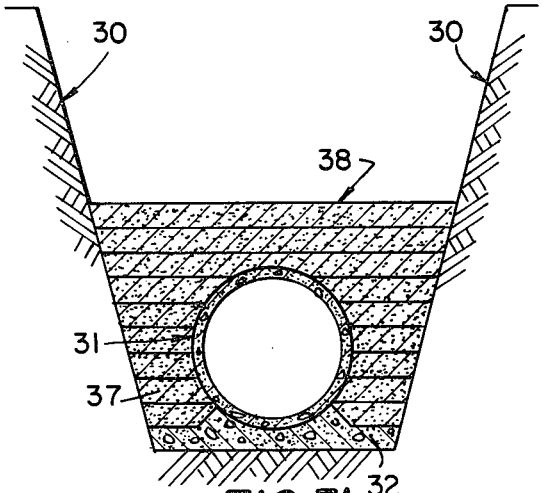
FIG. 3b
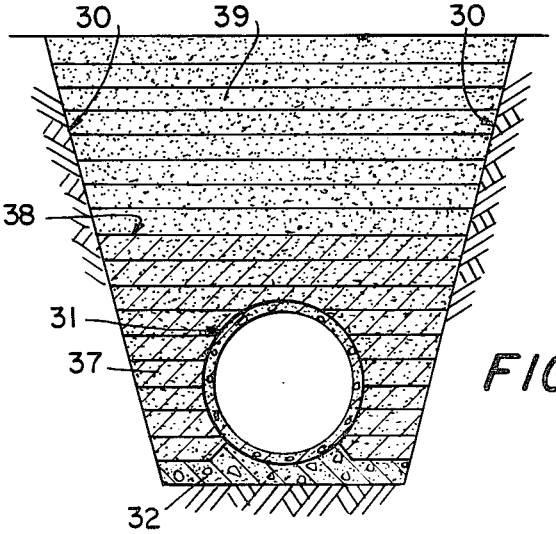
FIG. 3c

CONSTRUCTION OF UNDERGROUND GALLERIES

BACKGROUND OF THE INVENTION

The invention relates to a method of constructing underground galleries and finds particular application in the construction of tunnels which may be considered as a series of galleries joined end-to-end.

Throughout the specification the term "gallery" is used to describe the invention and such term is intended to include isolated galleries and chambers as well as tunnels.

The construction of tunnels has traditionally raised problems due to the large forces exerted by the earth or ground medium surrounding the tunnel. The construction of large diameter tunnels, such as are suitable for accommodating subways or roads, has proved particularly problematical due to the relatively large structural dimensions involved. On the other hand, the laying of relatively small diameter pipes is not so difficult since it is less easy for the overlying earth to crush the pipe. The present invention is primarily concerned with the construction of large diameter galleries such as, for example, subway tunnels.

Traditionally underground galleries and similar structures have been formed by one of two methods.

The first method involves boring below the earths surface and shoring up as the gallery or tunnel progresses.

The second method is the so-called "cut and cover" method whereby a pit or trench is excavated and the gallery or tunnel is assembled or built on the floor of the pit or trench. Thereafter the the trench is filled to cover the gallery or tunnel. In such a case the gallery or tunnel itself supports the entire load of the infilled earth material.

The present invention represents an improvement in the cut and cover method and makes it possible substantially to reduce the thickness of the gallery shell, thereby effecting a saving in materials. This is made possible by the fact that the applied backfill together with the gallery acts to support the total load of backfill, buildings, traffic, etc, thereby, removing much of the stress which would otherwise be applied directly to the gallery shell. Put another way, structures for galleries constructed by the "cut and cover method" must withstand by themselves all stresses originated by the total backfill weight. Consequently, those structures use large quantities of structural materials which substantially increases the cost of construction. In addition the greater consumption of materials complicates the use of precast units because of excessive weight or the need of a great number of joints. The present invention makes possible a reduction in the amount of structural materials utilised in galleries since the backfill becomes a structural element and the stresses originated by the total backfill weight are withstood jointly by the structure of the gallery and the backfill.

DESCRIPTION OF THE PRIOR ART

An exhaustive search has been conducted through the principal and related classes encompassing underground galleries, tunnels and methods of constructing same. That search revealed a volume of prior art but none of the prior art found, when considered either singly or in combination, anticipates or renders obvious the novel invention of this application.

Typical of the methods of tunnel construction revealed by the prior art are U.S. Pat. Nos. 2,749,713 (Friedrich-Wilhelm Paurat); 3,283,514 (Launay); 3,395,542 (Deloffre) and 3,462,959 (Mallander) all of which are concerned only with frame or arch structures for supporting the roofs of underground galleries.

Equally irrelevant are U.S. Pat. Nos. 3,490,242 (Schnabel) which relates to a reinforcing shoring structure and 3,381,479 (Curzio) which is concerned with bored (rather than cut and cover) galleries and particularly to the shoring of such a bore with a frame member or reticular structure.

U.S. Pat. Nos. 960,940 (Jackson) and 1,899,474 (Ono) are concerned with similar methods of constructing tunnels involving the initial construction of the sides of the tunnel, in the case of the former by walls and the latter by piles, and subsequently excavating the earth between the sides before applying roof structure. U.S. Pat. No. 1,637,586 (Pates) teaches the application of roofing structure to prepared walls and U.S. Pat. No. 1,474,808 (Zucco) is concerned only with a tunnel construction involving a shell comprising arched spaced ribs with interspersed concrete.

U.S. Pat. No. 2,230,032 (Freyssinet) is concerned merely with details of constructing a shell from preformed elements while U.S. Pat. No. 956,627 (Conkling) teaches the correction of distortion ocurring in already constructed tunnels.

U.S. Pat. Nos. 2,300,028 (Wilcox) and 3,750,407 (Heierli) are both concerned with the absorption of applied stresses, Wilcox by constructing his tunnel arch of substantially eliptical shape and Heierli by positioning an inflatable or expandible cushion member around the lining or shell of the tunnel or gallery.

Of all the prior art which has been found and considered, U.S. Pat. No. 2,272,382 (Mc Closkey) is perhaps the closest to the present invention but even Mc Closkey is far removed from the applicant's novel method of construction. Mc Closkey involves excavating a hole in the ground and providing the bottom of the hole with a profile which is the converse of the roof of a chamber to be formed. Thereafter a shell is applied over the hole bottom and concrete is laid. After the concrete has set the hole is refilled flush to the earth surface and only then is the true excavation below the reinforced shell effected to form an arched structure. The teaching of Mc Closkey does not even suggest applicant's novel method of construction and, moreover, suffers from the problem of the dual expense of firstly excavating in a manner that might be adopted for a cut and cover construction and secondly tunnelling by boring or otherwise removing earth from below the constructed chamber arch or dome.

Finally, U.S. Pat. No. 3,508,406 (Fisher) teaches the construction of a composite arch structure involving the utilization of buttresses.

The foregoing recitation and brief analysis of the prior art revealed by the search is included in this specification to substantiate not only that the applicant's method of construction according to the present invention is novel but also that there is not even a suggestion of the method of the invention.

SUMMARY OF THE INVENTION

The present invention involves a development of the known cut and cover method of constructing an underground gallery and provides an improvement over prior methods in that in the finished gallery the ground load above the gallery is not supported solely by the gallery shell.

The method of the present invention includes the steps of excavating a trench and locating a gallery within the trench. The gallery may either be built in situ on the trench floor or, preferably, prefabricated in annular sections which are lowered into the trench and subsequently joined together to form the completed structure.

The trench is then refilled but before the refill material can exert any substantial force on the gallery the gallery is braced by internal braces. The braces are most conveniently applied either before prefabricated sections are lowered into position or when the sections have been joined and before introduction of the backfill. Although these are the most convenient times to insert the braces, it would of course be possible to have the braces positioned during the initial stages of backfilling providing care is taken to ensure the bracing is completed before the backfill begins to apply any substantial force. In this manner the braces reinforce the gallery structure to withstand the load of the backfill.

The crux of the invention resides in the controlled application of the initial backfill in such manner that upon removal of the bracing from within the gallery the backfill initially applied which completely covers the gallery will form in conjunction with the gallery structure a load supporting arch over said gallery. At that point in time final backfill may be applied to complete filling of the trench and the weight of such final backfill will be borne jointly by the initially applied backfill and the gallery structure and not, as in the case of the prior art, solely by the gallery. Removal of the bracing may be effected at any time after the initially applied backfill is capable of adopting its load supporting function.

The actual point at which the initially applied backfill will assume a state of compaction and adopt an internal structure to support the subsequently applied load of final backfill and its own weight will depend on the nature of the ground material in which the gallery is constructed. Some soils have a consistency such that the arching effect will occur relatively close to the crown of the gallery and are generally termed "good soils" and neither special treatment thereof nor additions thereto is necessary. On the other hand, some soils, e.g. sandy or silty clays, without special treatment would either not adopt a load supporting condition or would only do so at a substantial height, for example more than 10 meters above the arch crown. The present invention teaches the treatment of such materials for example, by the addition of a stabilizing agent such as portland cement, to lower the height at which the supporting arch is formed. The amount of cement added will obviously govern the "stiffness" induced into the ground material to make it less deformable. Such treated material is generally referred to as "soil cement" and although it does not set to a rigid crust in the manner of a pavement it does stabilize the initially applied backfill to adopt a condition where compaction of the backfill will result in a load bearing arch in the preferred range of from two to four meters above the gallery.

As explained, the point at which the load supporting condition is reached will depend upon the stiffness induced into the initially applied backfill and this, in turn, will affect selection of the thickness of the gallery structure. This can be illustrated by considering the arching effect adopted by the initially applied backfill over and above the gallery.

With the arching effect so adopted upon removal of the bracing backfill above the arch will be supported jointly by the arch and gallery structure. Consequently the stiffer the initial backfill the closer to the gallery is the arching supporting effect achieved and the thinner may be the walls of the gallery.

This evidences a major advantage of the invention which makes it possible to reduce the amount of material utilized in building the gallery shell which not only represents a saving in cost of material employed but also facilitates construction by making it possible more easily to handle the gallery sections prior to embedding them within the ground.

The stiffness or deformability of the material used to refill the trench, which most conveniently will be the excavated ground material, will be considered in conjunction with its ability to settle which governs the elapse of time before a stable condition is reached and, in addition, any creep (i.e. deformation slowly over a period of years) characteristics of the ground material. By the addition of stabilizing material to the initially applied backfill, the time taken to settle will be shortened and creep eliminated.

Finally, water action also effects stresses on a constructed gallery since buoyancy will tend to reduce pressures exerted by the backfill. Furthermore, pressures due to water will act directly on the gallery shell confined by the backfill material and will remain constant. To a certain extent, the shape of the gallery can reduce the effect of such pressure and in all the examples described and illustrated in the description of preferred embodiments the gallery is of substantially circular configuration. This, however, is not essential and, for example, a horizontally orientated hourglass configuration might be appropriate if the gallery is to be a tunnel dimensioned to accomodate twin tracks of a subway.

Before begining excavation of the trench it is generally necessary to lower the water table by means of dewatering. This may be accomplished in any of a number of conventional ways. Upon completion of the backfilling operation the dewatering is stopped. Thereupon the water will seep back and exert pressure on the gallery.

Although the depth of excavation of the trench will obviously depend upon the individual circumstances, in case of cut and cover methods including the method of the invention depths will usually be in the range of from 2 to 4 times the height of the gallery.

BRIEF DESCRIPTION OF THE DRAWINGS

In order that the present invention may be more clearly understood and readily carried into effect, a number of embodiments will now be described with reference to the accompanying drawings, in which:

FIGS. 2(*a*) and 2(*b*) show an alternative method of construction in accordance with a second embodiment of the invention.

FIGS. 3(*a*) through 3(*c*) show a further embodiment of the invention,

DESCRIPTION OF THE PREFERRED EMBODIMENT

Figure 1A:
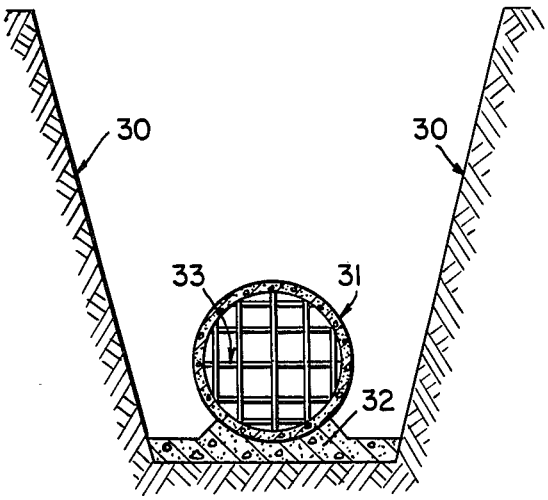
FIGS. 1(*a*) through 1(*d*) schematically represent the sequential steps of constructing an underground gallery by a method in accordance with one embodiment of the invention.
Figure 1B:
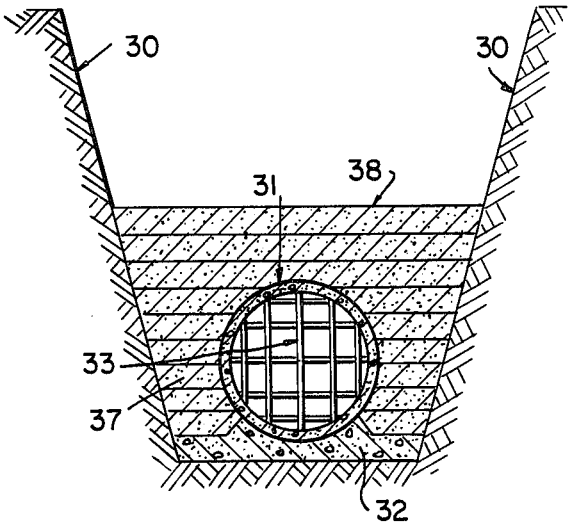
Figure 1C:
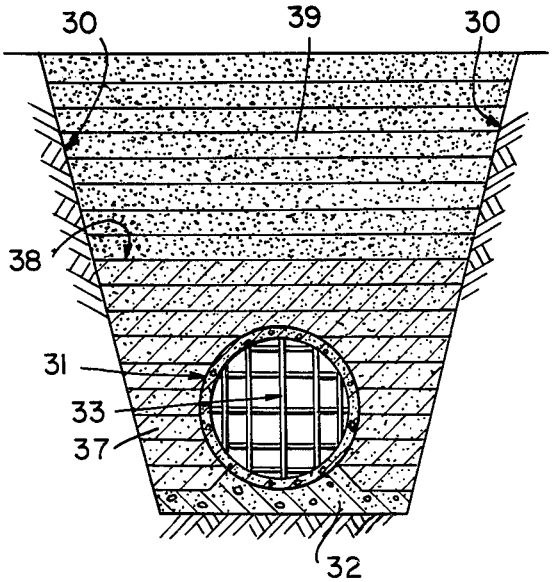
Figure 1D:
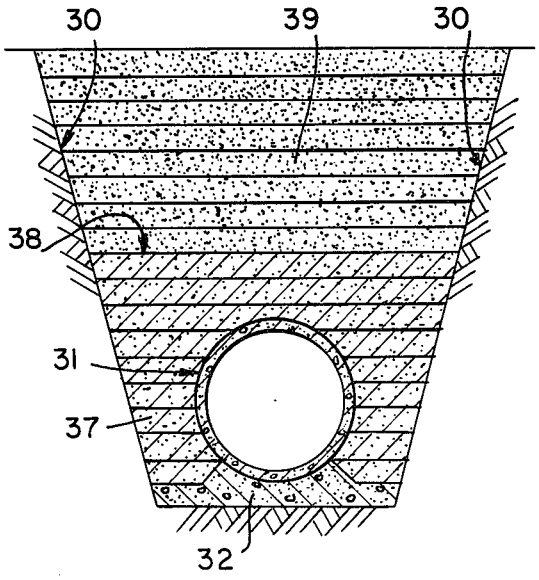

Referring now to the drawings in which like reference numerals are used to indicate corresponding parts in the several illustrated embodiments, FIGS. 1(*a*) through 1(*d*) show a first embodiment of the invention. As is most clearly shown in FIG. 1(*a*) a trench has been excavated by any conventional method and is shown with downwardly and inwardly sloping side walls (30) to eliminate the need for retaining braces. The conventional method adopted for excavating the trench will be largely determined by the circumstances and will depend upon a number of factors including, inter alia, the type of soil, excavation depth, loads imposed by adjacent buildings, protection of existing foundations and ground water level.

In the case of a high water table in the area where the tunnel or gallery is to be constructed, it will first be necessary to lower the ground water level. The lowering of the water level or dewatering may be achieved by any acceptable method and will not be described in detail.

Following excavation of the trench, compaction of the trench bottom may be effected by tamping or other compacting methods to provide a firm foundation for the gallery. To this end, the gallery may simply rest on the bottom of the trench for which purpose the trench bottom may be appropriately profiled as shown at 49 in FIG. 5. More usually, however, and as shown in FIGS. 1 through 4, a cradle (32) is placed on the trench bottom and is profiled to support the gallery (31).

Figure 6:
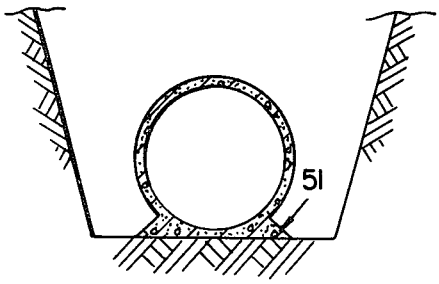
FIG. 6 shows a further alternative detail which may be incorporated in any of the embodiments of FIGS. 1 to 4.

FIG. 6 shows an embodiment where the gallery also rests on the bottom of the trench. In this case, however, the trench bottom is not profiled but instead the gallery rests directly on the trench bottom which has been appropriately hardened by tamping and is retained in position by wedges (51) which may either be applied in the manner of chocks or may be an integral part of the casting of the gallery. More usually, however, a cradle (32) is placed on the trench bottom and profiled to support the gallery (31). Again, the actual construction of such a cradle will vary depending on the circumstances and may, for example, be in the form of a one piece poured casting or in the form of a prefabricated structure which is assembled on site on the trench bottom. If a poured in place or precast concrete cradle is used it should, for purposes of complete support and rigidity, be dimensioned to cover the entire width of the trench bottom. Such a construction would in itself assist in retention of the trench walls (30) and if, instead of sloped side walls the trench walls are retained by braces (not shown), then the lowermost braces may be omitted or removed since then the concrete cradle extending from wall to wall across the trench provides a bracing effect.

With the cradle (32) firmly emplaced on the bottom of the trench, the gallery (31) is then positioned on the cradle. This method of construction is ideally suited to the utilization of precast sections which may be lowered into the trench, seated on the cradle and joined end to end to form a composite structure. The actual dimensions of the sections will vary depending upon the intended purpose of the construction and, for ease of handling, the length of the sections will be governed by the total weight and size thereof.

Generally, lengths of two to three meters are appropriate in the case of a tunnel for a subway system. The aligned sections are joined by circumferential joints in a known manner which need not to be described in detail.

It is contemplated within the scope of the invention that the gallery sections may be positioned within the trench before the material of a cast cradle has set. In this manner, a settable slurry of concrete and clay having a setting or hardening time of, for example, from ten to thirty hours, may be poured onto the already compacted bottom of an excavated trench. The prefabricated gallery sections may then be "floated" into the desired position before the slurry sets completely to support the gallery. Alternatively, the settable slurry may be poured into the trench after the gallery has been positioned therein.

It is crucial to the method of the invention that the assembled gallery sections be internally braced to withstand the exertion of external substantial forces which would otherwise damage the gallery. To this end although braces (33) might be applied after the sections are joined to form a tunnel shell, it is obviously more convenient to position such braces (33) in the individual sections before they are lowered into the trench. This however, may create a weight problem since the necessarily substantial weight of the braces may hinder transportation and emplacing of the gallery sections. To solve such problem it may be practical to apply some braces only before the sections are lowered into place and subsequently to complete the bracing when the sections are in situ. In any event, to avoid any damage to the sections, there should always be some braces within the sections when the latter are transported and moved into position.

Figure 7:
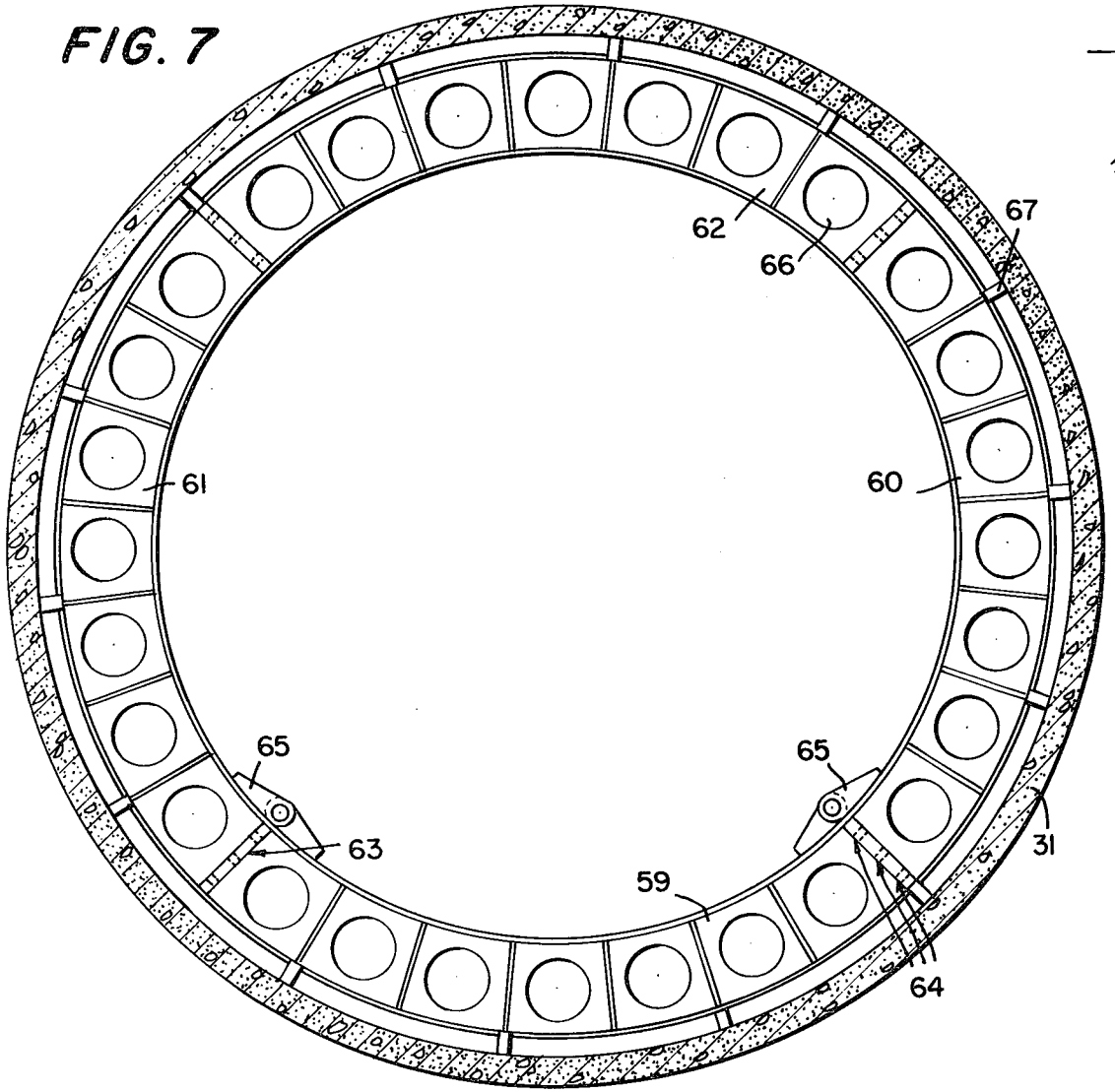
FIG. 7 shows an alternative of a different detail of construction which may be incorporated in any of the embodiments of FIGS. 1 to 4.

As shown schematically in FIGS. 1 through 4 the braces (33) may be applied in a lattice or grid formation. Alternatively, the braces may be arranged diametrically or radially (not shown) or may, as shown in FIG. 7, be provided by quadrant sectors (59, 60, 61, 62) interconnected by hinges (65) and extending peripherally around the inner surface of the gallery (31). Such sectors, which may have holes (66) for weight-reduction purposes, are secured in position by plates (63) and bolts (64) and shims (67) ensure a close fit with the gallery (31).

With the gallery in place on the cradle in the trench and with the gallery complete with internal bracing, the next step is to begin to fill the trench with backfill.

The various stages of the backfilling comprising an initial controlled backfill (37) and a subsequent final backfill (39) to the level of the top of the excavation are shown in FIGS. 1(*a*) through 1(*d*).

FIG. 1(*a*) shows the internally braced gallery (31) resting on the cradle (32) within the trench prior to the introduction of any backfill. In FIG. 1(*b*) the controlled initially applied backfill (37) has been introduced and carefully tamped or otherwise compacted. Although FIG. 1(*b*) shows all of the initial backfill in position, it is important that such backfill is not applied in a single batch but, rather, is built up layer by layer with each applied layer being carefully tamped or otherwise compacted before introduction of the next subsequent layer. The actual thickness or depth of each applied layer will depend on the conditions and 15 cm is a common thickness.

The final backfill (39) is then applied above the initial backfill (37) and is tamped to level the surface at ground level. Reference numeral (38) shows the demarkation between the initial (37) and final (39) backfills. FIGS. 1(*c*) and 1(*d*) schematically show that the final backfill has been similarly applied layer-by-layer. In the case of the final backfill, however, this may not be essential. FIG. 1(*c*) shows final backfill applied and tamped above the initial backfill before removal of the internal bracing from within the gallery. FIG. 1(*d*) shows this bracing removed.

FIG. 2(*a*) and 2(*b*) show a second embodiment of the invention. In this second embodiment there is no line of demarkation between initial and final backfills because the material used is the same. Although the material is the same, it is nevertheless applied in the same manner as in the first embodiment described with reference to FIGS. 1(*a*) to 1(*d*). That is to say, with the gallery or tunnel shell appropriately internally braced, the backfill is applied initially in a controlled manner and is tamped in place layer-by-layer until internal arching may provide sufficient support for the backfill. Thereafter, the backfilling operation is completed and the internal bracing (33) is removed as shown in FIG. 2(*b*).

Figure 4A:
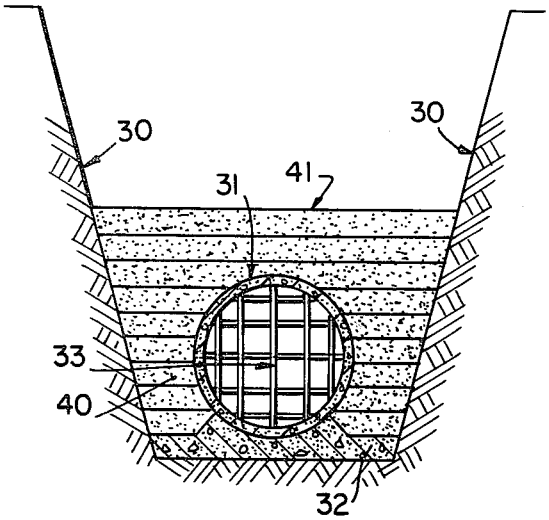
FIGS. 4(*a*) through 4(*c*) show a still further embodiment of the invention.
Figure 4B:
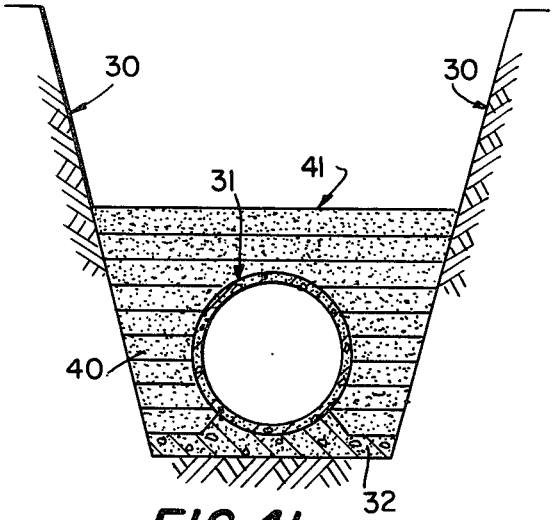
Figure 4C:
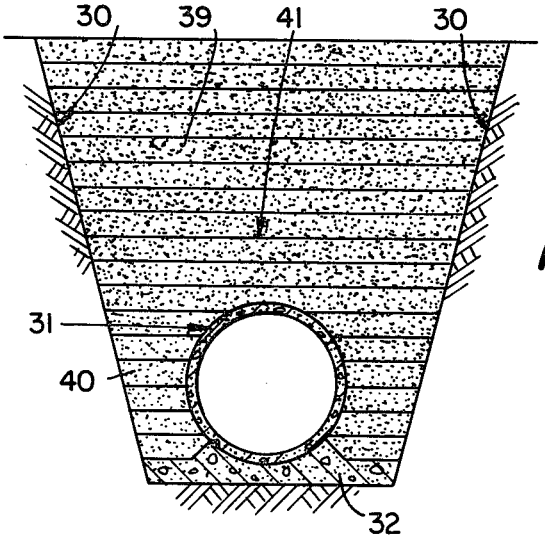
Figure 5:
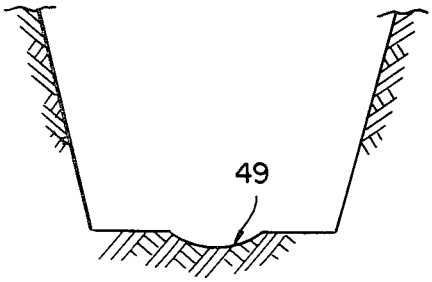
FIG. 5 shows an alternative detail of construction which may be incorporated in any of the embodiments of FIGS. 1 to 4.

FIGS. 3 and 4 respectively show minor variations of the methods described and illustrated with reference to FIGS. 1 and 2. In the case of each of these variations, the internal bracing (33) is removed during the backfilling operation. Thus, FIG. 3(*a*) shows a condition corresponding to FIG. (*b*) where the initial backfilling (37) has been applied in a controlled manner up to the level (38). Thereupon, the internal bracing (33) is removed as shown in FIG. 3(*b*) and the final backfill (39) applied is shown in FIG. 3(*c*). Similarly in FIG. 4(*a*) backfilling (40) is applied in a controlled manner up to a level (41) whereupon the bracing (33) is removed (FIG. 4(*b*)) prior to completion of the backfilling operation with the same material (FIG. 4*c*). In each case the initially applied backfill must be capable of achieving its load bearing function due to removal of the bracing.

In these embodiments, the gallery is a concrete shell. However other materials may be utilised within the scope of the accompanying claims and include, for example, steel and cast iron.

A complete explanation of the support characteristics of the backfill, together with specific examples will now be described and given.

The crux of the invention resides in the combined support provided by the gallery shell and the initially applied backfill. This support is provided by the initial backfill adopting an arching effect which provides with the gallery shell support for the load of the backfill.

As described, the method of the invention involves excavating the trench, emplacing the gallery within the trench ready to receive the backfill, ensuring that the gallery so emplaced is internally braced before applied backfill will exert any substantial force on the gallery, applying backfill initially in controlled amounts, completing the backfill up to the ground surface level and removing the internal braces from the gallery.

Before removing the braces, pressures on the gallery lining or shell are those caused by the weight of the backfill and resisted fully by the interior bracing. Upon removal of the braces the initially applied backfill assumes a structural function and together with the gallery shell contributes to resist the stresses originated by the total weight imposed. The bracing can be removed when the initially applied backfill has been applied to a depth at which upon removed of said bracing said material will adopt an internally arched structure. Providing this condition is observed, the bracing may be removed before, during or after the final backfill is applied.

Compaction of the initially applied backfill (37) regardless of materials utilized must be carefully performed, leaving no voids or defective areas.

Compaction of the backfill material immediately adjacent the gallery shell should begin with smaller equipment until a protective compacted layer is built above the shell. Thereafter larger vibrating compactors may be utilized.

In the case of braced trenches conventional compaction equipment such as mechanical rollers may be inappropriate and compaction will be performed with hand vibrating compactors, mechanical tampers, etc. As backfilling progesses removal of trench bracing is performed and after removal of the remaining bracing, larger size compacting equipment can enter the trench to complete the job. At this stage, of course, extreme care must be exercised to avoid damaging existing utilities.

From the foregoing detailed description it will be appreciated that the method of construction of the invention produces an underground gallery in which the total load of the ground above the gallery is not borne by the material of the gallery but jointly by the gallery and the initially applied backfill which forms a supporting arch within the ground above the gallery.

The extent to which the arching effect is achieved by and within the initially applied backfill is controlled and will be determined by many factors, among the most important of which is the actual nature of the ground material. Other factors governing the load supporting characteristics of the initially applied backfill include the outside dimensions of the gallery, the thickness of the gallery shell, and the total depth of the trench which governs the total weight of material above the gallery.

Consequently, in order to achieve optimum construction conditions with consequent saving of costly materials including labor it is in most situations necessary to treat that portion of the excavated ground material which will be tamped and compacted around and over the gallery structure positioned within the trench.

This treatment will be exemplified by the following examples, which are included for illustrative purposes only, which have been established by research and calculation with five ground conditions. The results of the researched examples are tabulated in Table I and establish that it was necessary to treat each ground material differently in order to achieve the desired arching load bearing characteristics within a preferred range.

Figure 8:
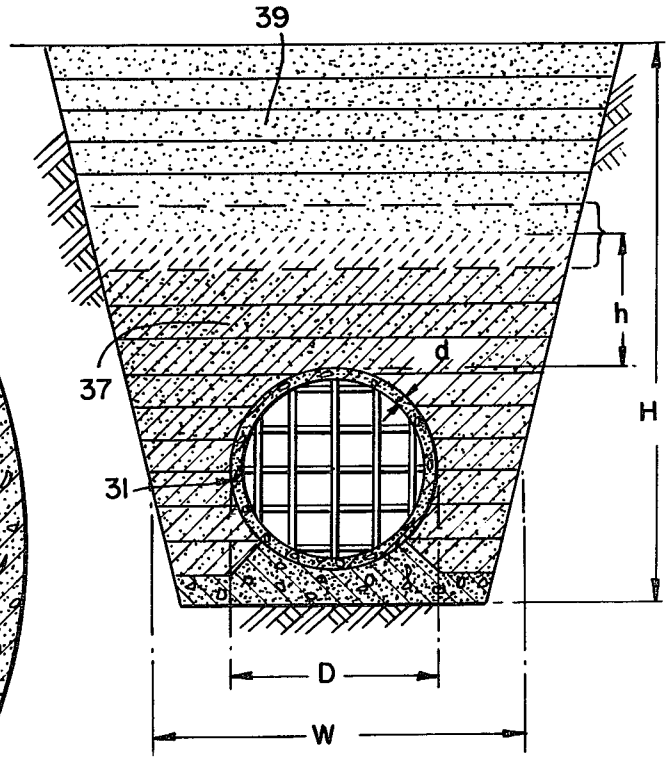
FIG. 8 is a schematic diagram showing dimensional parameters referred to in specific examples given in the following description

Before detailing the composition and consistency of each of the five sample ground conditions, reference is made to FIG. 8 of the drawings which illustrates constants utilized in the calculations.

The illustrative examples are in each case based on a trench of uniform depth (H) and width (W) at the level of the horizontal major axis of the gallery and a gallery shell having both uniform diameter (D) and shell thickness (d). In the examples considered, these constants are as follows:

H=21 meters
W=10 meters
D=6 meters
d=0.10 meters

Consequently, in the case of each example the total depth of earth above the positioned gallery is 15 meters.

In each example, in order to locate the arching effect of the initially applied backfill at a mean location (h) above the top of the gallery (31) the extracted earth is mixed with portland cement and water at atmosphere pressure and applied layer-by-layer with compacting as described.

Setting time of the compacted initially applied backfill (37) without any accelerating additives will be at least 6 days and thereafter the braces may be removed and the remaining or final backfill applied. This setting time may be accelerated by using additives in known manner.

The five soil samples considered are selected from the Unified Soil Classification System (USCS) adopted by the Corps of Engineers and Bureau of Reclamation and are as follows:

SAMPLE I—Gravels having a grain structure where more than 50% of the coarse fraction of the material will not pass through a standard No. 4 sieve and compacted to a relative density of not less than 70% The relative density is defined as the ratio $$\frac{e_{max} - e}{e_{max} - e_{min}}$$

Where $e_{max}$ = maximum void ratio
$e_{min}$ = minimum void ratio
e = void ratio SAMPLE II—Sand having a grain structure where more than 50% of the coarse fraction of the material will pass through a standard No. 4 sieve and compacted to a relative density (as calculated in Sample I) of not less than 70%.

In both SAMPLE I and SAMPLE II poorly graded materials, i.e. those in which the sizes of the individual grains are too similar to achieve good compaction must be treated—for example, by the addition of other granular structure—to provide a mixture with grain sizes appropriately varying within accepted limits for compaction.

SAMPLE III—Sandy or Silty clays having a liquid limit of less than 50 and compacted to not less than 98% of maximum density at within −2% of the optimum moisture content.

SAMPLE IV—Fine sands and silts which have a liquid limit of less than 50 and which, unlike the clays of Sample III may tend to creep, i.e., deform slowly with time over a prolonged period under constant load.

SAMPLE V—Fine sands and silts having a liquid limit of greater than 50 and exhibiting the same creep characteristics as Sample IV.

These samples are all classified according to the Unified Soil Classification System in which Samples I and II are so-called coarse-grained materials in which more than 50% of the grains will not pass through a standard No. 200 sieve. According to the same classification, samples III to V are so-called fine-grained soils in which more than 50% of the grains will pass through such a sieve.

The need to treat these earth samples to locate the necessary arching effect at the desired location (h) is substantiated by considering that, for example, in the case of Sample III if no such treatment were to be effected, the arching effect would not be achieved until a point some 10 to 14 meters above the crown of the gallery (31) which is clearly undesirable where the total depth of earth above the gallery is only 15 meters. Indeed, in the cases of Samples IV and V a depth of 15 meters would be insufficient to achieve the supporting arching effect unless the initial backfill is treated.

TABLE I reproduced herebelow specifies the parameters of the mixtures utilized in the illustrative examples to cause the load bearing arching effect to occur at the mean height(h) (column 3). The amount of cement added is indicated in column (4) and the water content in the complete treated mixture is indicated in column (5).

TABLE I

| (1) SAMPLE | (2) HEIGHT OF ARCHING EFFECT WITH BACKFILL OF UNTREATED SOIL METERS | (3) HEIGHT OF ARCHING EFFECT WITH TREATED BACKFILL METERS | (4) PORTLAND CEMENT % BY WEIGHT | (5) WATER CONTENT IN MIXTURE % BY WEIGHT |
|---|---|---|---|---|
| I | 5–8 | 3±1 | 3–9 | 7–10 |
| II | 7–10 | 3±1 | 3–9 | 9–12 |
| III | 10–14 | 3±1 | 5–11 | 10–14 |
| IV | — | 3±1 | 8–12 | 10–13 |
| V | — | 3±1 | 9–14 | 11–14 |

The above reproduced table is a compilation of calculations based on actual soil samples and utilizing portland cement with an appropriate moisture content in the set mixture.

This required moisture content will be achieved by addition of water unless the soil sample is too wet initially in which case it will be achieved by drying.

In all the samples considered in the above table, the initially applied backfill is mixed with a stabilizing material identified as cement. A stabilized load bearing structure can be achieved by utilising "Lean Concrete" as the initial backfill. Such lean concrete will have as its ingredients portland cement, sand, crushed rock (gravel) and water. The relative proportions of these ingredients in the mixed lean concrete will be determined by the compressive strength desired. For example, in a situation where the initially applied backfill, when set, is to have a compressive strength of approximately 50 kg/sq cm, the ingredients would be mixed as follows:

| | |
|---|---|
| Portland Cement | 80kg/cu meter |
| Sand | 880kg/cu meter |
| Crushed Rock | 1220kg/cu meter |

-continued

| | |
|---|---|
| Water | 180 litres |

Of course, other stabilizing materials, for example, lime or resins may be utilized to bring about the desired solidifying stabilization, or setting of the initially applied backfill to produce a load bearing structure.

I claim:

1. A method of constructing an underground gallery comprising excavating to form a pit having a depth greater than the overall height of the gallery, locating the gallery within the pit, internally bracing the structure of said gallery to withstand loads exerted by ground material upon refilling of the pit, covering the gallery and filling the pit with ground material, said covering being effected initially by applying and compacting backfill material in incremental steps around and over the gallery, removing said bracing from within the gallery and thereby causing said initially applied backfill material to adopt an internal arching structure which together with said gallery will support applied loads, and completing the filling of the pit.

2. A method according to claim 1, wherein the initially applied backfill is applied layer-by-layer.

3. A method according to claim 1, wherein the initially applied backfill and subsequently applied final backfill are the same material and are of the same consistency.

4. A method according to claim 1, wherein the initially applied backfill and subsequently applied final backfill have a different composition.

5. A method according to claim 4, wherein the initial backfill comprises a mixture of the material of the backfill and stabilizing material.

6. A method according to claim 5, wherein the ground material is a coarse-grained soil, having a grain size of which more than 50% will not pass through a standard No. 200 sieve and wherein the initially applied backfill comprises such ground material mixed with from 3% to 9% by weight of portland cement to provide a mixture with a controlled water content of from 7% to 12% by weight.

7. A method according to claim 5, wherein the ground material is a fine-grained soil having a grain size of which more than 50% will pass through a standard No. 200 sieve and wherein the initially applied backfill comprises such ground material mixed with from 5% to 14% by weight of portland cement to provide a mixture with a controlled water content of from 10% to 14% by weight.

8. A method according to claim 1, wherein the gallery is positioned on a cradle within the pit.

9. A method according to claim 7 wherein the gallery is a composite structure comprising a plurality of prefabricated sections which are lowered into the pit and assembed therein to form said composite structure.

10. A method according to claim 1, wherein the gallery is constructed in the pit.

11. A method according to claim 1, wherein the internal braces are arranged inside the gallery structure in a grid formation.

12. A method according to claim 1, wherein the gallery is of substantially circular configuration and wherein each brace comprises four quadrant sectors assembled within said gallery to mate with the internal surface of the gallery shell substantially around the entire periphery thereof.

13. A method according to claim 1, wherein the braces are applied inside the gallery before the gallery is lowered into the pit.

14. A method according to claim 1, wherein the braces are applied inside the gallery after said gallery has been positioned within the pit and before initially applied backfill can exert any substantial load on said gallery.

15. A method according to claim 1, wherein the braces are removed when the pit has been completely filled.

16. A method according to claim 1, wherein the pit is a trench.

17. A method according to claim 18, wherein the gallery is a tunnel.

18. A method of constructing an underground gallery comprising the steps of excavating a trench having a depth greater than the overall height of the gallery, laying the gallery along the trench bottom, inserting braces inside the gallery to brace the peripheral shell thereof against external pressure, beginning to fill the trench with ground material to embed the gallery, said filling comprising the steps of initially applying and compacting backfill material layer-by-layer in incremental steps to cover the gallery to a depth at which upon removal of the bracing from within the gallery the initially applied backfill will adopt an internal structure which together with said gallery will support applied loads, removing said bracing from within the gallery to permit some shifting of the initially applied backfill to adopt an internal load supporting arching structure and completing the filling of the trench.

19. A method according to claim 18, wherein the gallery comprises a plurality of prefabricated segments sequentially lowered into the trench and then joined end-to-end to lie along the trench bottom.

20. A method according to claim 18, wherein the initially applied backfill and subsequently applied final backfill are the same material and are of the same consistency.

21. A method according to claim 18, wherein the initially applied backfill and subsequently applied final backfill have a different composition.

22. A method according to claim 21, wherein the initial backfill comprises a mixture of the material of the backfill and stabilizing material.

23. A method according to claim 22, wherein the ground material is a coarse-grained soil having a grain size of which more than 50% will not pass through a standard No. 200 sieve and wherein the initially applied backfill comprises such ground material mixed with from 3% to 9% by weight of portland cement to provide a mixture with a controlled water content of from 7% to 12% by weight.

24. A method of constructing a tunnel comprising the steps of excavating a trench, locating supporting cradles along the bottom of said trench, sequentially lowering a plurality of prefabricated annular tunnel sections into said trench and aligning said sections on said cradles in end-to-end relationship, joining said aligned sections to form an elongated annular tunnel shell, positioning braces within the shell to reinforce said shell to resist the load exerted by ground material when the trench is filled, applying initial backfilling material layer-by-layer and compacting each applied layer before proceeding with the next subsequent layer, said initially applied backfill comprising a mixture of the excavated ground material and portland cement in a proportion of from 3% to 9% by weight, said mixture having a moisture content of from 7% to 12% by weight, continuing incrementally to apply said initial backfill around, over and above the tunnel shell up to a depth at which said mixture will adopt an arching effect upon removal of the braces, completing filling of the trench to the ground surface with final backfilling material comprising the excavated ground material without any additions and compacting the final backfill material during application thereof and finally removing said braces from within the embedded tunnel.

* * * * *